US007597430B2

(12) United States Patent
Umeda

(10) Patent No.: US 7,597,430 B2
(45) Date of Patent: Oct. 6, 2009

(54) INK SUPPLY APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 550 days.

(21) Appl. No.: 11/420,691

(22) Filed: May 26, 2006

(65) Prior Publication Data

US 2006/0268042 A1 Nov. 30, 2006

(30) Foreign Application Priority Data

May 27, 2005 (JP) ..... 2005-156043

(51) Int. Cl.
*B41J 2/175* (2006.01)

(52) U.S. Cl. ..... 347/85

(58) Field of Classification Search ..... 347/7, 347/19, 84, 85

See application file for complete search history.

(56) References Cited

U.S. PATENT DOCUMENTS 4,380,770 A 4/1983 Maruyama
4,476,472 A 10/1984 Aiba et al.
4,896,172 A * 1/1990 Nozawa et al. ..... 347/17
6,139,138 A 10/2000 Powers et al.
6,196,668 B1 * 3/2001 Bode ..... 347/85
6,322,207 B1 * 11/2001 Hall et al. ..... 347/85
7,044,579 B2 * 5/2006 Katsuumi ..... 347/30
7,182,444 B2 * 2/2007 Kawamoto ..... 347/85

FOREIGN PATENT DOCUMENTS

GB 2326378 A 12/1998
JP 11091121 A 6/1999

OTHER PUBLICATIONS

European Search Report, EP Appl'n No. 06 25 2755 (Counterpart to U.S. Appl. No. 11/420,691) dated Aug. 22, 2006.

* cited by examiner

*Primary Examiner*—Anh T. N. Vo
(74) *Attorney, Agent, or Firm*—Baker Botts, LLP

(57) ABSTRACT

A supply path of ink to connect an exchangeable ink cartridge and a recording head for discharging ink is provided. Also, a pump which can supply the ink stored in the supply path through a confluent portion of the supply path and the pump; and an ink detecting sensor for detecting the ink in the supply path at the confluent portion or on the ink cartridge side with respect to the confluent portion are provided. When the ink detecting sensor detects that there is no ink, the detection result is reported, and after the exchange of the ink cartridge, the pump is drive-controlled to supply the ink to the supply path, and to return the air in the supply path back to the ink cartridge. A supply pressure of the pump is a pressure where a meniscus in the recording head is not broken.

17 Claims, 9 Drawing Sheets

INK SUPPLY APPARATUS

CROSS-REFERENCE TO RELATED APPLICATIONS

This Nonprovisional application claims priority under 35 U. S. C. §119(a) on Patent Application No. 2005-156043 filed in Japan on May 27, 2005, the entire contents of which are hereby incorporated by reference.

BACKGROUND

The present invention relates to an ink supplying apparatus that supplies ink from a cartridge to a recording head for discharging the ink.

Conventionally, as an ink supplying apparatus that supplies ink in an exchangeable ink cartridge to a recording head and also warns a fact that the ink cartridge becomes empty, an apparatus disclosed in Japanese Patent Application Laid Open No. 11-91121 (1999) is known. This apparatus is designed such that a sub-tank is placed in a supply path of the ink between the ink cartridge and the recording head, and the ink in the ink cartridge can be supplied to the sub-tank by using a pump. Also, a liquid surface level sensor for detecting an ink liquid surface level is provided in the sub-tank. Then, if the ink liquid surface level detected by the liquid surface level sensor becomes a predetermined level or less, the pump is used to supply the ink from the ink cartridge to the sub-tank. Even if the pump is driven, if the ink liquid surface level detected by the liquid surface level sensor is the predetermined level or less, the ink cartridge is judged to be empty, and a warning for urging a user to exchange the ink cartridge is issued.

SUMMARY

However, in the conventional apparatus, the sub-tank is placed in the supply path between the ink cartridge and the recording head. Thus, the apparatus becomes complex, which results in a problem that the apparatus is large in size.

It is therefore an object to provide an ink supplying apparatus which is simple in configuration and small in size.

In order to attain the object, the following method is employed to solve the object. That is, this is an ink supplying apparatus, comprising: an exchangeable ink cartridge; a recording head for discharging ink; a supply path of the ink to connect said ink cartridge and said recording head; a pump which can supply the ink stored in said supply path through a confluent portion of said supply path and the pump; an ink detecting unit for detecting said ink in said supply path at said confluent portion or on said ink cartridge side with respect to said confluent portion; and a controller capable of: when the ink detecting unit detects that there is no ink, reporting the detection result; and after an exchange of said ink cartridge, drive-controlling said pump to supply said ink to said supply path and to return air in said supply path back to said ink cartridge.

In the ink supplying apparatus, the ink inside the supply path at the confluent portion or on the ink cartridge side with respect to the confluent portion is detected by the ink detecting means, and the detection result is reported. Thus, the ink cartridge can be used until it becomes empty, and after the exchange of the ink cartridge, the ink is supplied from the pump to the supply path, and the air is returned back to the ink cartridge. Hence, the sub-tank is not required, which provides the effect that enables the simpler configuration and the size reduction.

The above and further objects and features will more fully be apparent from the following detailed description with accompanying drawings.

DETAILED DESCRIPTION OF THE EXEMPLARY EMBODIMENT

The best mode of carrying out this embodiment will be described below in detail-with reference to the drawings.

Figure 1:
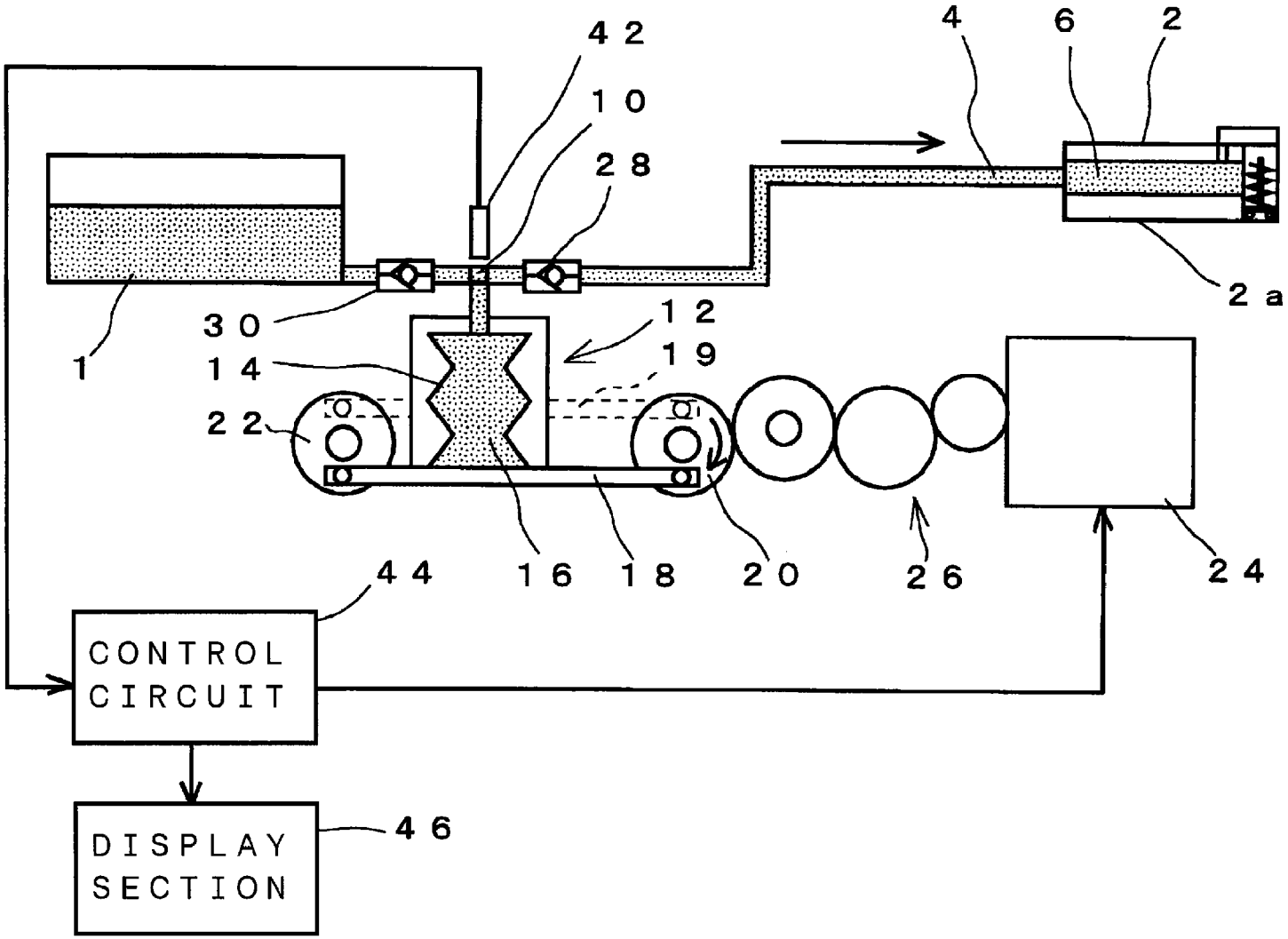
FIG. 1 is a schematic configuration view of an ink supplying apparatus as an embodiment.
Figure 2:
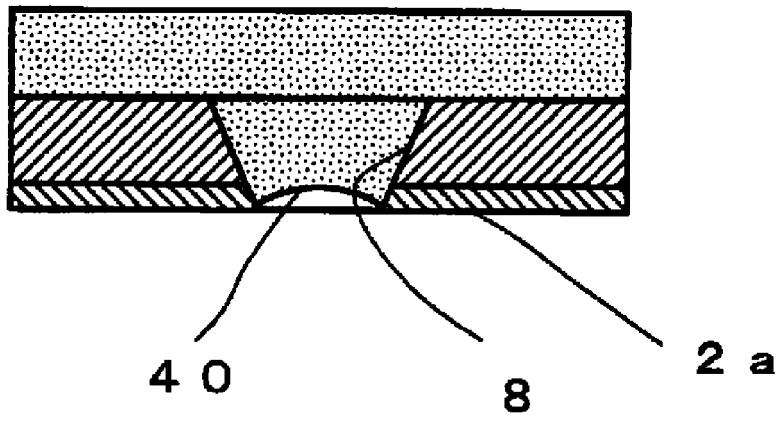
FIG. 2 is an explanation view showing a meniscus generated in a nozzle of a recording head in this embodiment.

As shown in FIG. 1, an exchangeable ink cartridge 1 and a recording head 2 are connected through a supply path 4 of ink. In this embodiment, the recording head 2 is the ink jet type, which drives a piezoelectric element, a thermally converting element and the like and discharges the ink supplied through the supply path 4 to a manifold 6 from a nozzle 8 (refer to FIG.2) as an ink drop.

A pump 12 is connected at a confluent portion 10 in the course of the supply path 4 between the ink cartridge 1 and the recording head 2. The pump 12 is not directly connected to the ink cartridge 1, and it is connected at the confluent portion 10 in the course of the supply path 4. The supply path 4 from the confluent portion 10 to the ink cartridge 1 is located on the lower side in a gravity direction than a nozzle surface 2*a* of the recording head 2. Consequently, in such a way that a negative pressure can be applied, even if the ink cartridge 1 becomes empty which will be described later, a back pressure can be stably applied to the recording head 2.

As the pump 12, in this embodiment, a bellows pump is used. A pump chamber 16 constituted by a bellows 14 is linked to the confluent portion 10. The bellows 14 is designed so as to be expanded or contracted, and the expansion/contraction of the bellows 14 is configured so as to change the capacity of the pump chamber 16. By the way, the pump 12 is not limited to the bellows 14. Then, a bellows, a balloon and the like which have the expansion/contraction performance may be used.

The bellows 14 is provided on an elevating bar 18, and both ends of the elevating bar 18 are rotatably supported on sides of the rotation plates 20, 22, respectively. Both ends of a linkage bar 19 are rotatably supported on the sides of the rotation plates 20, 22 at a position symmetrical with the elevating bar 18. Then, when both of the rotation plates 20, 22 are rotated in the same direction, the elevating bar 18 is configured so as to be elevated.

As shown in FIG. 1, when the rotation plates 20, 22 are rotated by 180 degrees, the elevating bar 18 is raised from the lowest position indicated by a solid line in FIG. 1 to the highest position. Moreover, when the rotation plates 20, 22 are rotated by 180degrees, they are returned back to the original lowest position shown by the solid line. When the elevating bar 18 is raised from the low position to the high position, the bellows 14 is contracted to consequently change the capacity of the pump chamber 16.

The pump chamber 16 is at least formed so as to store the ink which is equal to or greater than the capacity of the supply path 4 between the ink cartridge 1 and the portion (the confluent portion 10, in this embodiment) where an ink detecting sensor 42 (ink detecting means) is provided. Then, this is designed so as to discharge the ink which is equal to or greater than the capacity of the supply path 4 between the ink cartridge 1 and the portion where the ink detecting sensor 42 is provided, while the elevating bar 18 is raised from the lowest position to the highest position.

This apparatus is designed such that a rotation of a driving source 24, such as a motor or the like, is transmitted through a gear mechanism 26 to one rotation plate 20. By the way, the driving source 24 may be configured such that it is shared as a driving source for rotating a platen or the like (not shown) to send a recording medium such as a paper and the like and such that they are switched by the gear mechanism 26.

Figure 3:
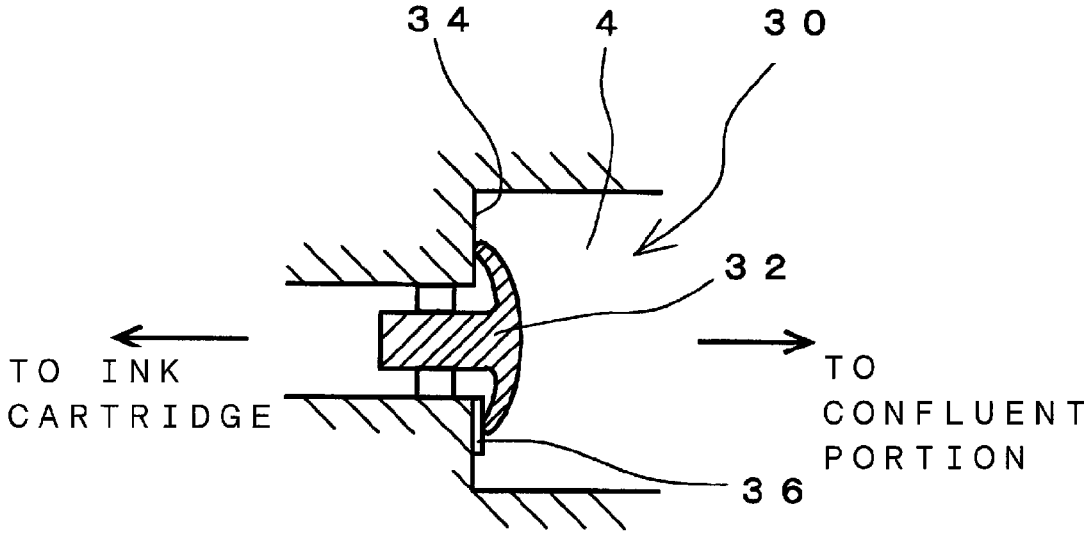
FIG. 3 is a schematic configuration view of a check valve in this embodiment.

In the supply path 4, check valves 28, 30 are placed on both sides of the confluent portion 10 with the confluent portion 10 therebetween, respectively. Both of the check valves 28, 30 are placed so as to allow the ink to flow to the recording head 2 from the ink cartridge 1. Also, the check valve 30 between the ink cartridge 1 and the confluent portion 10 includes a flexible valve body 32 having a shape of an umbrella, as shown in FIG.3 and is seated on a valve seat 34 formed in the course of the supply path 4 and regulates the flow of the ink to the side of the ink cartridge 1 from the confluent portion 10.

A protrusion 36 is formed on the valve seat 34 and the check valve 30 is configured such that and such that a part of the valve body 32 is brought into contact with the protrusion 36. When the ink pressure of the confluent portion 10 side is the pressure where a meniscus 40 generated in the nozzle 8 is not broken, a gap is formed between the valve body 32 and the valve seat 34 in the vicinity of the protrusion 36, and the ink flows to the ink cartridge 1 side from the confluent portion 10 side.

On the other hand, the ink detecting sensor 42 is provided in the confluent portion 10. The ink detecting sensor 42 may be provided in the supply path 4 between the confluent portion 10 and the ink cartridge 1. The ink detecting sensor 42 detects the presence or absence of the ink in the supply path 4 at the portion where the ink detecting sensor 42 is provided, and it may be a photo type, an electric resistance type or the like.

The ink detecting sensor 42 and the driving source 24 are connected to a control circuit 44 (a controller) and includes a CPU which controls the driving source 24 and the like in accordance with a control program with regard to an operation content, a ROM, a RAM and the like. A display section 46 is connected to the control circuit 44, and the display section 46 includes a light emitting diode, which is flashed when the ink cartridge is empty, and the like.

Figure 4:
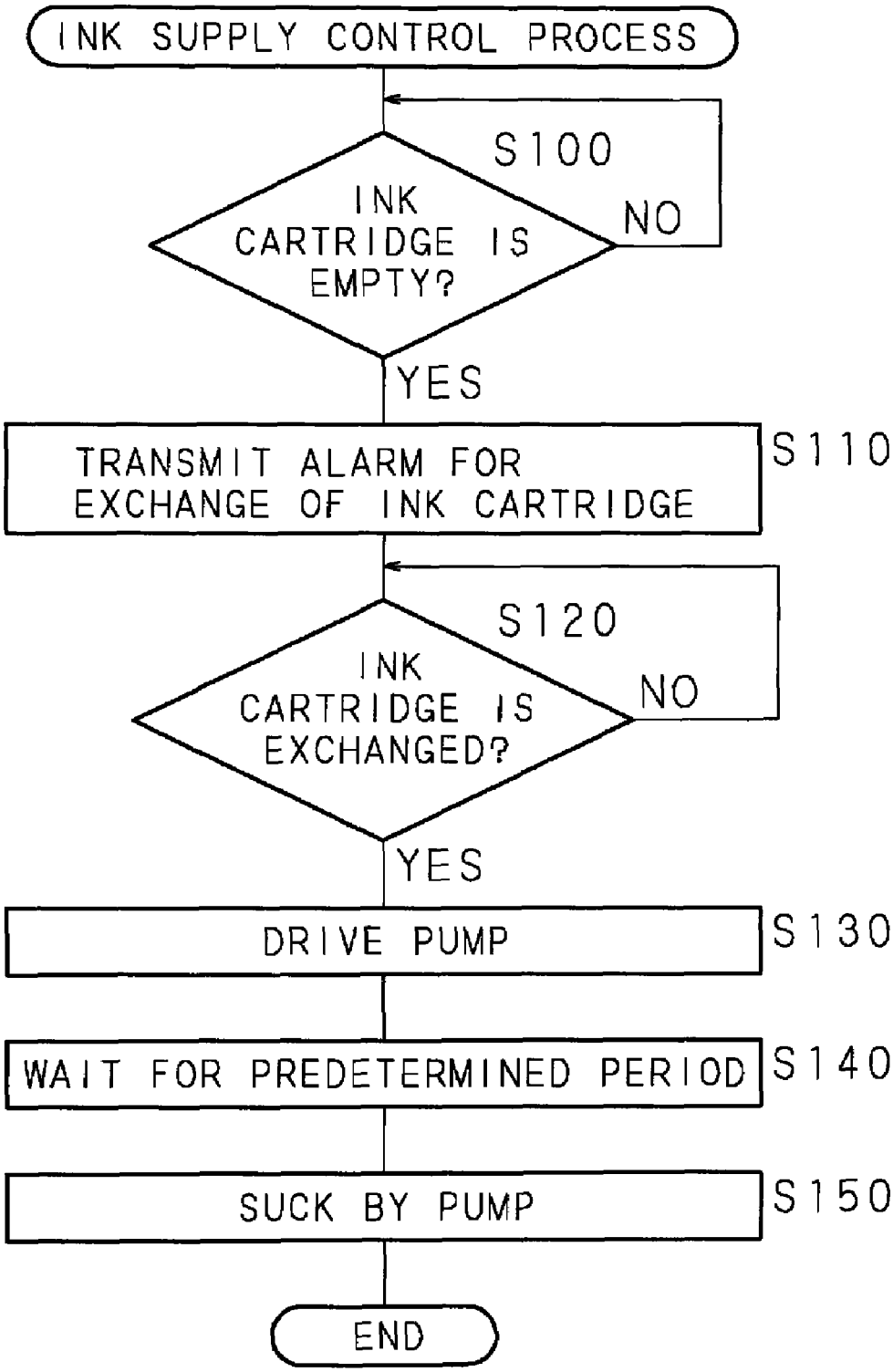
FIG. 4 is a flowchart showing an example of an ink supply control process executed in a control circuit in this embodiment.

An ink supply control process executed in the control circuit 44 will be described below with reference to a flowchart shown in FIG.4.

At first, the recording head 2 is driven in accordance with an image data, and the ink in the manifold 6 is discharged as the ink drop from the nozzle 8 to the recording medium such as a paper and the like, and the pattern of an ink dot is recorded. The consumed ink is supplemented from the ink cartridge 1 through the supply path 4 and the check valves 28, 30 to the manifold 6. With the consumption of the ink, the ink in the ink cartridge 1 is reduced, thereby lowering an ink liquid surface level inside the ink cartridge 1.

While the recording is being done, the ink supply control process is repeatedly executed for each constant time. At first, whether or not the ink cartridge is empty is judged (Step 100). Whether or not the ink cartridge is empty is judged in accordance with the result of the presence or absence of the ink detected by the ink detecting sensor 42.

Figure 5:
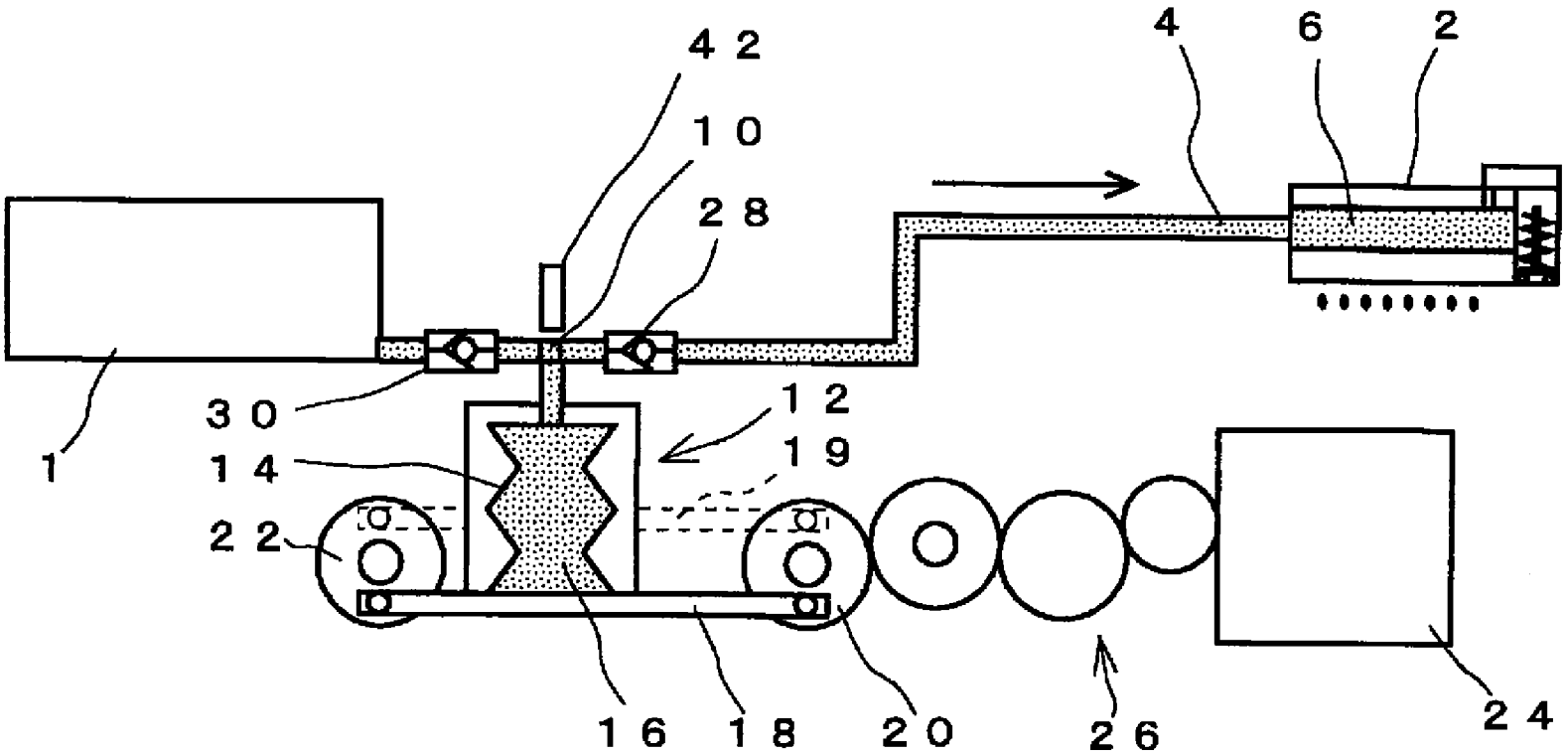
FIG. 5 is a schematic configuration view showing a recording state in the ink supplying apparatus in this embodiment.

If there is the ink (Step 100: No), it waits in an original state, and the recording through the recording head 2 is continued. Then, when the ink in the ink cartridge 1 is consumed, as shown in FIG.5, the ink cartridge 1 becomes empty. The ink still remains in the supply path 4 between the ink cartridge 1 and the ink detecting sensor 42. Moreover, the recording to the recording medium is continued.

Figure 6:
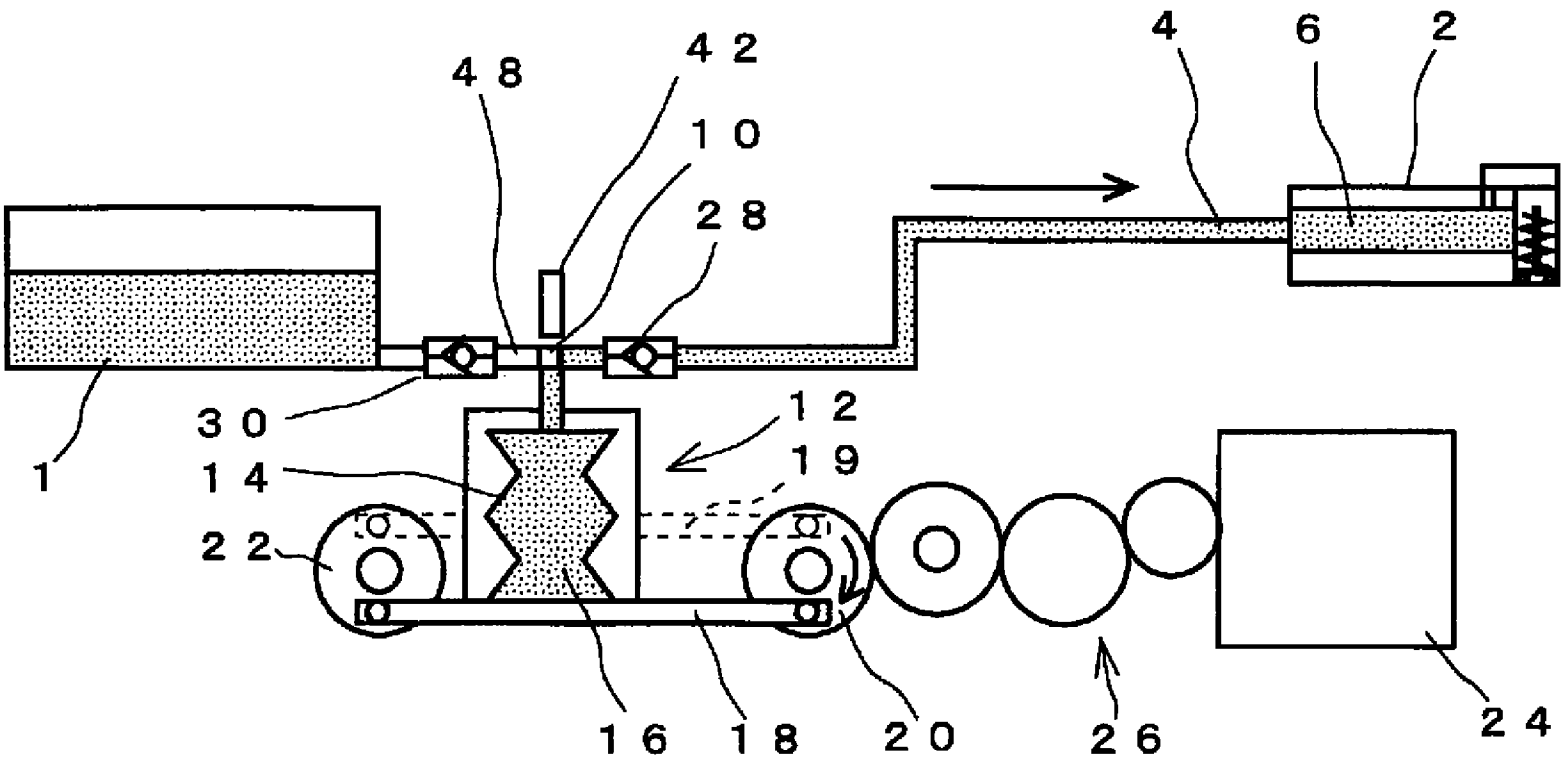
FIG. 6 is a schematic configuration view showing a situation when an ink cartridge in the ink supplying apparatus in this embodiment is exchanged.

When the recording is continued and the ink in the supply path 4 between the ink cartridge 1 and the ink detecting sensor 42 is even consumed, as shown in FIG.6, if the ink liquid surface reaches the confluent portion 10, the ink detecting sensor 42 detects that there is no ink. Thus, it is judged that there is no ink and the ink cartridge is empty (Step 100: Yes), and the driving of the recording head 2 is stopped one time, and an alarm signal for instructing the exchange of the ink cartridge 1 is transmitted (Step 110). In accordance with this alarm signal, the light emitting diode in the display section 46 is flashed, or the alarm signal is transmitted to an external apparatus such as a personal computer and the like. Then, the fact that the ink cartridge 1 becomes empty and must be exchanged is reported to the user.

Next, whether or not the ink cartridge 1 is exchanged is judged (Step 120), and it waits until the exchange is carried out (Step 120: No). As shown in FIG.6, when it is exchanged with a new ink cartridge 1 (Step 120: Yes), the pump 12 is driven (Step 130). When the ink cartridge 1 is exchanged, air 48 remains between the ink cartridge 1 and the confluent portion 10 where the ink detecting sensor 42 is provided. By the way, whether or not the ink cartridge 1 is exchanged may be judged, for example, in accordance with a detection signal or the like by detecting a fact that a cover (not shown) or the like is opened and closed when the ink cartridge 1 is exchanged.

When the pump 12 is driven, the control circuit 44 controls the rotation number of the driving source 24, and the rotation plate 20 is rotated through the gear mechanism 26. Consequently, the elevating bar 18 is raised to contract the bellows 14. Then, the ink is supplied from the bellows 14 through the confluent portion 10 to the supply path 4.

When the bellows 14 is contracted, the rotation number of the driving source 24 is controlled such that the ink pressure discharged from the bellows 14 becomes the pressure under which the meniscus 40 in the nozzle 8 is not broken, for example, the pressure of about 4 kPa. Consequently, under the pressure where the meniscus 40 is not broken, the ink is supplied through the confluent portion 10 to the supply path 4.

The meniscus 40 is generated in the nozzle 8 in the recording head 2. Thus, when the ink is supplied under the pressure where the meniscus 40 is broken, the ink is discharged from the nozzle 8. Hence, since the ink pressure discharged from the pump 12 is set to the pressure where the meniscus 40 is not broken, the ink flows from the confluent portion 10 through the supply path 4 to the side of the ink cartridge 1, and it does not flow from the confluent portion 10 to the supply path 4 on the side of the recording head 2.

By the way, an electromagnetic opening/closing valve may be placed in the supply path 4 between the confluent portion 10 and the recording head 2, and when the pump 12 is driven, the electromagnetic opening/closing valve may be closed. At that time, the ink pressure discharged from the pump 12 may be equal to or greater than the pressure where the meniscus 40 is broken. By setting the ink pressure discharged from the pump 12 to the pressure where the meniscus 40 is not broken, it is possible to return the air 48 back to the ink cartridge 1 without providing the electromagnetic opening/closing valve. Thus, the structure becomes simpler.

The ink flows from the confluent portion 10 into the supply path 4 on the side of the ink cartridge 1 and pushes the air 48, which remains in the supply path 4, toward the ink cartridge 1. In the case of the pressure where the meniscus 40 is not broken, the check valve 30 allows the flow to the side of the ink cartridge 1. Thus, the air 48 and the ink flow through the check valve 30 into the ink cartridge 1. The air 48 flowing into the ink cartridge 1 is changed into air bubble and raised as shown in FIG.7 and sent out from the ink cartridge 1 to atmosphere.

Consequently, the ink cartridge 1 can be used until the ink cartridge 1 becomes perfectly empty, and the air 48 inside the supply path 4 is exhausted into the ink cartridge 1 by driving the pump 12. Thus, the ink cartridge 1 can be exchanged without uselessly discarding the ink. Moreover, the sub-tank and the like are not required to be provided, which enables the simpler structure and the size reduction.

Also, the pump 12 discharges the ink, which is equal to or greater than the capacity of the supply path 4 between the ink cartridge 1 and the portion where the ink detecting sensor 42 is provided. Thus, the configuration is simple. That is, the bellows 14 is used to discharge the necessary quantity of the ink, while the elevating bar 18 is raised from the lowest position to the highest position. Hence, the configuration of the pump 12 becomes simple.

Figure 7:
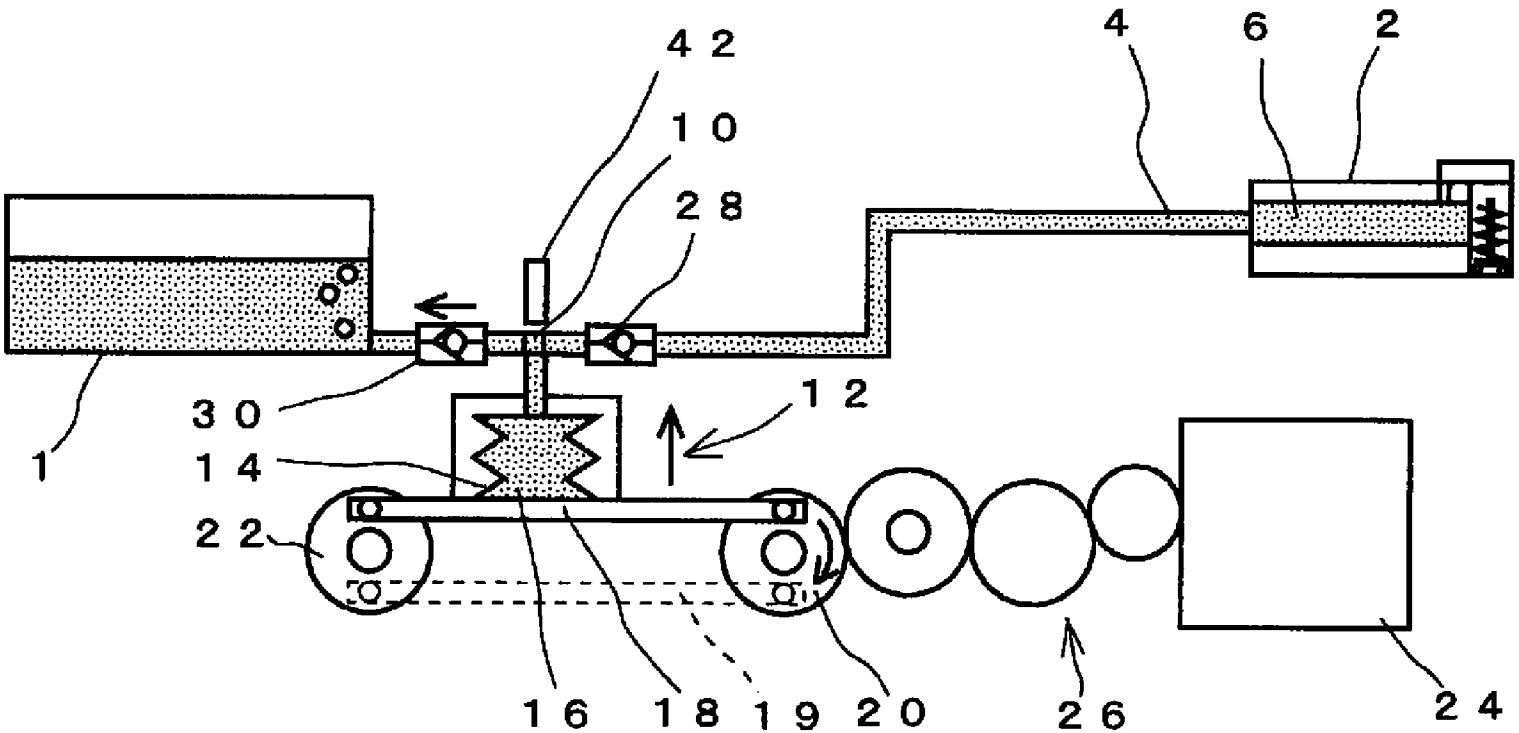
FIG. 7 is a schematic configuration view showing a situation when a pump in the ink supplying apparatus in this embodiment is driven to exhaust air.
Figure 8:
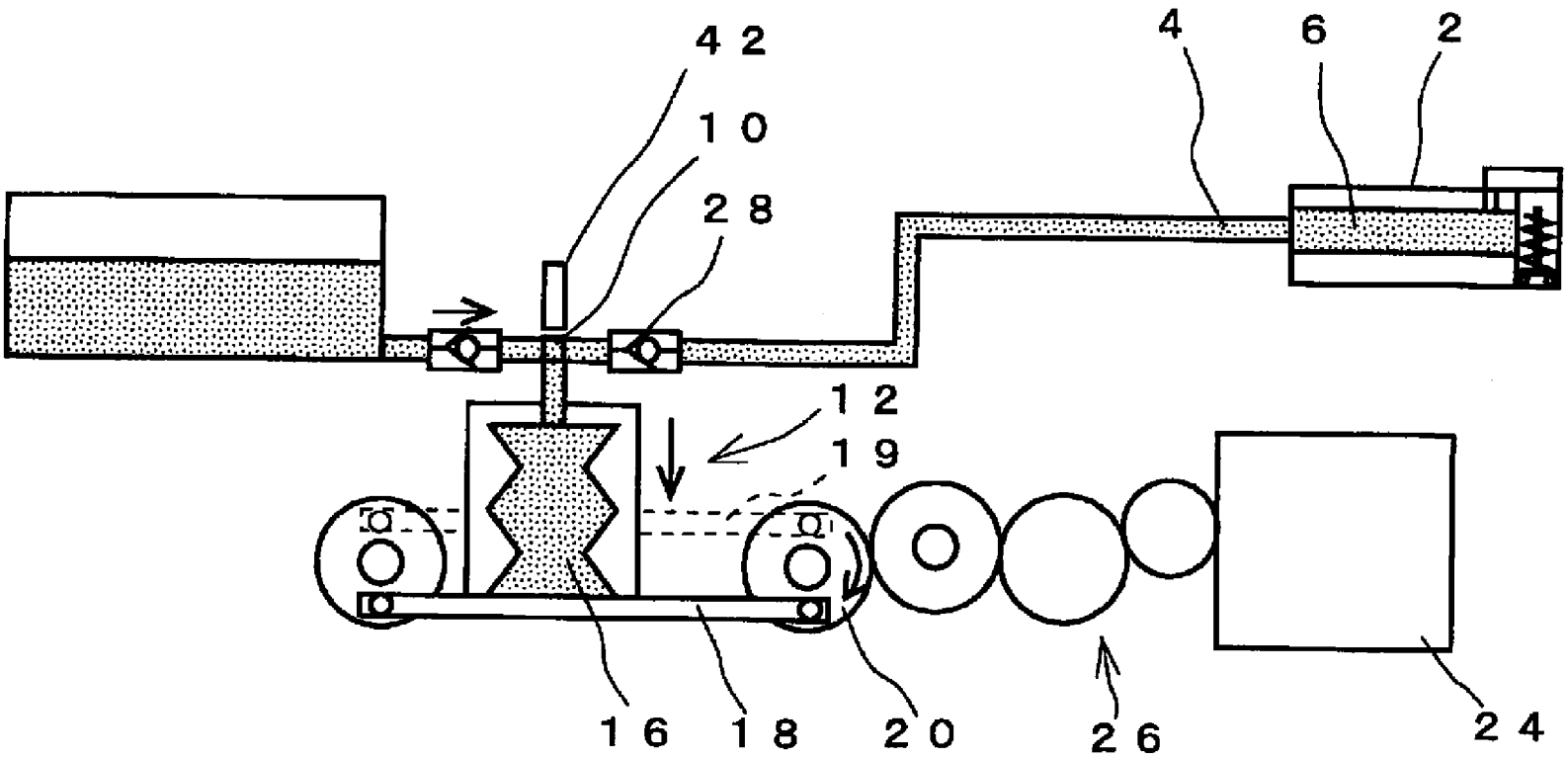
FIG. 8 is a schematic configuration view showing a situation when ink is sucked into the pump from the ink cartridge in the ink supplying apparatus in this embodiment.

Next, the pump 12 is driven to raise the elevating bar 18 to the highest position, as shown in FIG.7, and it waits for the elapse of the predetermined period (Step 140), and the sucking operation is carried out by the pump 12 (Step 150). In the sucking operation by the pump 12, as shown in FIG.8, the driving source 24 is controlled to transmit the rotation of the driving source 24 through the gear mechanism 26 to the rotation plate 20.

Consequently, the elevating bar 18 is moved from the highest position to the lowest position, and the bellows 14 is meanwhile expanded to increase the capacity. Thus, the ink is sucked from the ink cartridge 1 through the supply path 4 and the check valve 30 into the pump chamber 16 of the bellows 14, and the pump chamber 16 is filled with the ink. After the exhaustion of the air 48, since the ink is sucked into the pump chamber 16, the pump 12 of the simple configuration using the bellows 14 can be used.

At the time of the sucking operation by the pump 12, even if the ink tries to flow from the side of the recording head 2 to the side of the pump chamber 16, the other check valve 28 is closed to regulate the flow. After the sucking operation by the pump 12 is ended, this control process is ended one time. By the way, in this embodiment, the execution of the processes at the steps 100, 110 acts as the reporting means. The execution of the processes at the steps 120 to 140 acts as the exhaustion control means.

Figure 9:
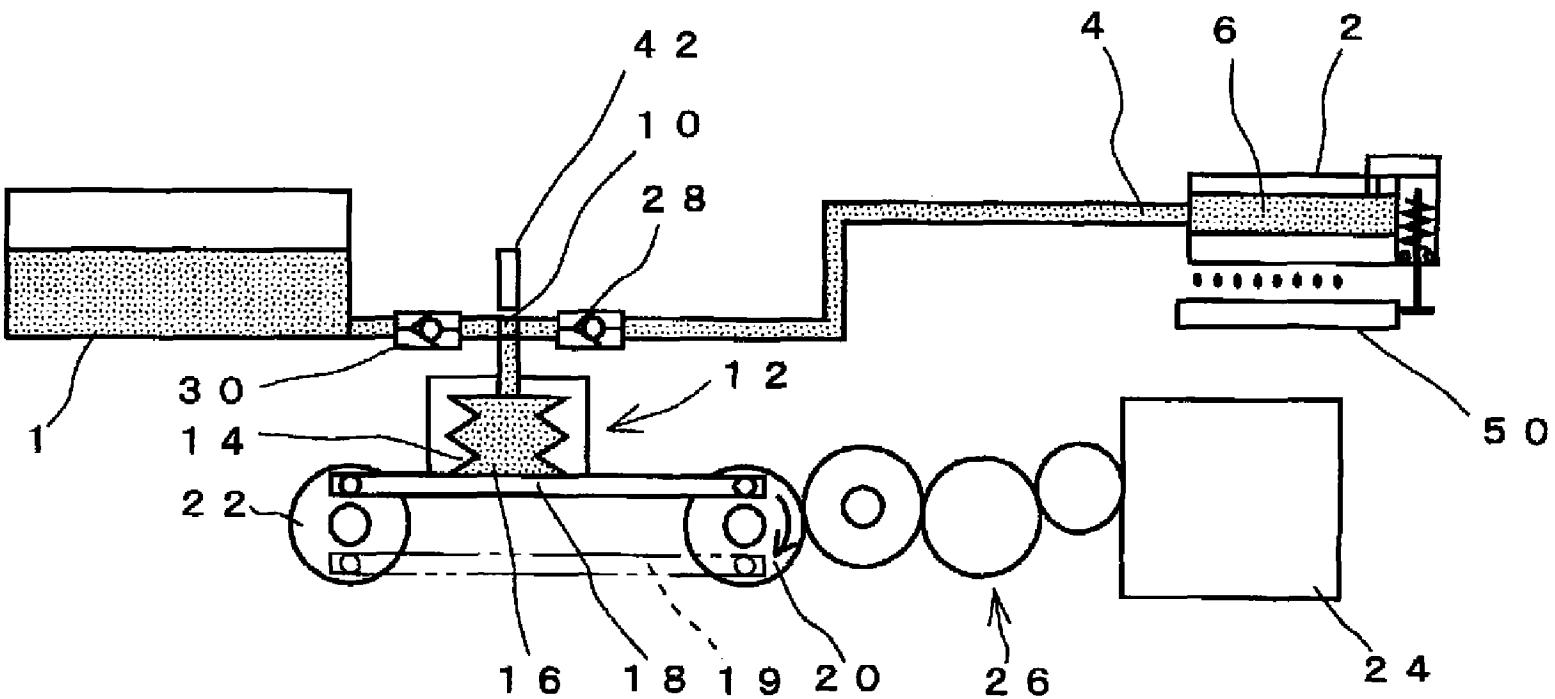
FIG. 9 is a schematic configuration view showing a state at a time of a purging operation in the ink supplying apparatus in this embodiment.

In this embodiment, as shown in FIG.9, pursing means for carrying out a purging operation is also shared by driving the pump 12. That is, the pump 12 is driven to contract the bellows 14, and the ink is supplied from the pump chamber 16 through the confluent portion 10 to the supply path 4 and supplied through the check valve 28 to the recording head 2. Consequently, the ink can be discharged from the nozzle 8 and sucked into a waste fluid foam 50. At that time, the check valve 30 prevents the ink from flowing back to the ink cartridge 1. Thus, the dry ink and the like can be suitably exhausted, thereby protecting the nozzle 8 from being clogged. Since the check valves 28, 30 are provided on both the sides of the confluent portion 10, the purging operation can be shared.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An ink supplying apparatus, comprising:

an exchangeable ink cartridge;

a recording head for discharging ink;

a supply path of the ink to connect said ink cartridge and said recording head;

a pump which comprises a chamber configured to draw and store ink from the ink cartridge and to supply the ink stored in the chamber to said supply path through a confluent portion of said supply path and the pump; and a controller configured to judge whether the ink cartridge is exchanged, and when the controller judges that the ink cartridge has been exchanged, said pump is drove to supply said ink stored in the chamber before an exchange of said ink cartridge to said supply path on the ink cartridge side with respect to the confluent portion and to return air in said supply path on the ink cartridge side with respect to the confluent portion back to said ink cartridge.

2. The ink supplying apparatus according to claim 1, wherein a supply pressure of said pump is a pressure under which a meniscus of said ink in the said recording head is not broken.

3. The ink supplying apparatus according to claim 2, further comprising check valves, which are provided on both sides of said confluent portion in said supply path and allow a flow to said recording head side, wherein said check valve on said ink cartridge side allows a back flow under said supply pressure.

4. The ink supplying apparatus according to claim 1, wherein the chamber is a pump chamber whose capacity is variable, and the pump chamber can store said ink which is equal to or greater than a capacity of said supply path between said ink cartridge and said confluent portion.

5. The ink supplying apparatus according to claim 1, wherein said confluent portion is arranged on a lower side than a nozzle surface of said recording head.

6. The ink supplying apparatus according to claim 1, wherein said controller is configured to drive said pump to return air in said supply path back to said ink cartridge and to subsequently draw said ink from said ink cartridge and store said ink in the chamber.

7. The ink supplying apparatus according to claim 1, further comprising:

an ink detecting unit for detecting said ink in said supply path at said confluent portion or in said supply path on said ink cartridge side with respect to said confluent portion; and a reporting unit for reporting the detection result when the ink detecting unit detects that there is no ink.

8. An ink supplying apparatus, comprising:

an exchangeable ink cartridge;

a recording head for discharging ink;

a supply path of the ink to connect said ink cartridge and said recording head;

a pump which comprises a chamber configured to draw and store ink from the ink cartridge and supply the ink stored in the chamber to said supply path through a confluent portion of said supply path and the pump; and exhaustion control means whether the ink cartridge is exchanged, and when said control means for judging judges that the ink cartridge has been exchanged, driving said pump to supply said ink stored in the chamber before an exchange of said ink cartridge to said supply path on the ink cartridge side with respect to the confluent portion and to return air in said supply path on the ink cartridge side with respect to the confluent portion back to said ink cartridge.

9. The ink supplying apparatus according to claim 8, wherein a supply pressure of said pump is a pressure under which a meniscus of the ink in said recording head is not broken.

10. The ink supplying apparatus according to claim 9, further comprising check valves, which are provided on both sides of said confluent portion in said supply path and allow a flow to said recording head side, wherein said check valve on said ink cartridge side allows a back flow under said supply pressure.

11. The ink supplying apparatus according to claim 8, wherein said chamber is a pump chamber whose capacity is variable, and the pump chamber is configured to store said ink which is equal to or greater than a capacity of said supply path between said ink cartridge and said confluent potion.

12. The ink supplying apparatus according to claim 8, wherein said confluent portion is arranged on a lower side than a nozzle surface of said recording head.

13. The ink supplying apparatus according to claim 8, wherein said exhaustion control means drives said pump to return air in said supply path back to said ink cartridge and to subsequently draw said ink from said ink cartridge and store said ink in the chamber.

14. The ink supplying apparatus according to claim 8, further comprising:

ink detecting means for detecting said ink in said supply path at said confluent portion or in said supply path on said ink cartridge side with respect to said confluent portion; and reporting means for reporting the detection result when the ink detecting means detects that there is no ink.

15. An ink supplying method for supplying ink in an ink supplying apparatus comprising: an exchangeable ink cartridge; a recording head for discharging ink; an ink supply path connecting said ink cartridge to said recording head; and a pump comprising a chamber configured to draw and store ink from the ink cartridge and to supply the ink stored in the chamber to said ink supply path through a confluent portion of said supply path and the pump, the ink supplying method comprising:

a step of drive-controlling said pump to draw and store the ink from the ink cartridge;

a step of judging whether said ink cartridge is exchanged; and an air exhaustion step of driving the pump, when said ink cartridge is judged to have been exchanged, to supply said ink stored in the chamber before an exchange of said ink cartridge to said supply path on said ink cartridge side with respect to said confluent portion and to return air in said supply path on said ink cartridge side with respect to said confluent portion to said ink cartridge.

16. The ink supply method according to claim 15, wherein said pump supplies ink under an ink pressure in which a meniscus of the ink in said recording head is not broken.

17. The ink supply method according to claim 15, further comprising a step of drawing said ink from said ink cartridge and storing said ink in said chamber after the air exhaustion step.

* * * * *